United States Patent [19]

Hirabayashi et al.

[11] Patent Number: 4,529,329

[45] Date of Patent: Jul. 16, 1985

[54] BALLPOINT PEN WITH METALLIC ROD BALL SEAT

[75] Inventors: Masao Hirabayashi, Kawagoe; Takeshi Mizutani, Kuwana, both of Japan

[73] Assignee: Shachihata Industry Co., Ltd., Japan

[21] Appl. No.: 502,527

[22] Filed: Jun. 9, 1983

[30] Foreign Application Priority Data

Jun. 16, 1982 [JP] Japan ..... 57-89938[U]

[51] Int. Cl.[3] ..... B43K 1/08; B43K 7/10

[52] U.S. Cl. ..... 401/209; 401/199; 401/216

[58] Field of Search ..... 401/199, 209, 216

[56] References Cited

U.S. PATENT DOCUMENTS

| | | | |
|---|---|---|---|
| 2,594,083 | 4/1952 | Silver | 401/216 X |
| 2,880,702 | 4/1959 | Joyce | 401/209 |
| 4,076,428 | 2/1978 | Otake et al. | 401/292 X |
| 4,139,313 | 2/1979 | Hori | 401/216 |

FOREIGN PATENT DOCUMENTS

| | | | |
|---|---|---|---|
| 1461620 | 4/1969 | Fed. Rep. of Germany | 401/216 |
| 1808601 | 7/1969 | Fed. Rep. of Germany | 401/216 |
| 2307620 | 8/1974 | Fed. Rep. of Germany . | |
| 2451610 | 10/1975 | Fed. Rep. of Germany . | |
| 972140 | 1/1951 | France | 401/216 |
| 30711 | 11/1960 | Japan . | |
| 17770 | 7/1970 | Japan . | |
| 4528414 | 9/1970 | Japan | 401/216 |
| 26344 | 10/1970 | Japan . | |
| 7887 | 3/1973 | Japan . | |
| 4104 | 1/1977 | Japan . | |
| 10979 | 3/1977 | Japan . | |
| 55-7422 | 2/1980 | Japan | 401/209 |
| 18295 | 1/1982 | Japan . | |
| 2073676 | 10/1981 | United Kingdom | 401/209 |

*Primary Examiner*—Steven A. Bratlie

*Attorney, Agent, or Firm*—Brumbaugh, Graves, Donohue & Raymond

[57] ABSTRACT

A writing instrument with a ballpoint pen comprising a metallic fine rod having a plurality of capillary holes for flowing ink from one end thereof through the other end in the interior thereof, a short cylindrical portion extending from one end thereof, and an annular narrowed portion on the peripheral edge of the front end of the short cylindrical portion;

a hard ball rotatably fitted to and held inside the annular narrowed portion and the short cylindrical portion and being in contact with one end of the metallic fine rod inside the short cylindrical portion;

and means for introducing aqueous ink connected to the other end of the metallic fine rod.

2 Claims, 35 Drawing Figures

BALLPOINT PEN WITH METALLIC ROD BALL SEAT

The present invention relates to a writing instrument with a ballpoint pen, more specifically, a writing instrument with a ballpoint pen suitable for using aqueous ink.

Conventional writing instruments with ballpoint pen tip are mainly suitable for using oily ink having a high viscosity. Recently, a writing instrument with a ballpoint pen tip in which a low viscosity aqueous ink is used has been developed. In this writing instrument, however, since an ink introducing portion for introducing ink to a space between a ball and a portion holding the ball and to the peripheral surface of the ball is formed by machinery cutting, it is not possible to always maintain accuracy of the dimension properly. Accordingly, it has been known that transferring or introducing an appropriate amount of aqueous ink having a low viscosity to the peripheral surface of the ball is difficult. Unless accuracy of the dimension is always maintained properly as mentioned above, it causes such problems that lines written on paper with this writing instrument break or disconnect, and that ink leaks from the writing instrument.

The main object of the present invention is to provide a writing instrument with a ballpoint pen tip which can eliminate above-mentioned problems, and in which both oily ink having a low viscosity and aqueous ink can be used.

Another object of the present invention is to provide a writing instrument with a ballpoint pen tip wherein an appropriate amount of oily ink having a low viscosity or aqueous ink can be continuously transferred to the outer surface of the ball, and clear writing can be continued for a long time without breaking or disconnecting of written lines regardless of a writing speed, as well as ink can be fed to the outer surface of the ball continuously without being dripped.

According to the present invention, there is provided a writing instrument with a ballpoint pen tip comprising a metallic fine rod having a plurality of capillary holes for flowing ink from one end thereof through the other end in the interior thereof, a short cylindrical portion extending from one end thereof, and an annular narrowed portion on the peripheral edge of the front end of the short cylindrical portion; a hard ball rotatably fitted and held inside the annular narrowed portion and the short cylindrical portion and being in contact with one end of the metallic fine rod within the short cylindrical portion; and means for introducing aqueous ink connected to the other end of the metallic fine rod.

According to the present invention, there is further provided a writing instrument with a ballpoint pen tip comprising a fine tube of which the front end is annularly narrowed to define an opening, a fine rod having a hollow short cylindrical portion in the front end portion of the fine tube and being inserted tightly into the fine tube, the thin rod having a plurality of capillary holes for flowing ink from one end thereof through the other end in the interior thereof, a ball rotatably supported between one end of the fine rod and the annularly narrowed portion around the opening within the short cylindrical portion, and means for introducing aqueous ink connected to the other end of the fine rod.

According to the present invention, there is further provided a writing instrument with a ballpoint pen tip comprising a fine tube which comprises a front end annularly narrowed to define an opening, a small diameter tip portion continued from the front end, a truncated conical portion continued from the small diameter tip portion, and a large diameter cylindrical portion continued from the truncated conical portion; a hollow pen point holder comprising a truncated conical head portion and a guiding tubular portion continued from the head portion; the fine tube being tightly inserted into the pen point holder at the large cylindrical portion thereof; a fine rod tightly inserted into the small diameter tip portion of the fine tube; the fine rod having a plurality of capillary holes for flowing ink from one end thereof through the other end in the interior thereof; a ball rotatably supported between the annularly narrowed portion to define the opening and the front end of the fine rod; means for introducing aqueous ink tightly inserted into the truncated conical portion and the large diameter cylindrical portion in the fine tube and the guiding tubular portion of the pen point holder and connected to the inner end of the fine rod; an intermediate holder comprising a substantially cylindrical portion, a small diameter portion continued from it, a cylindrical portion continued from it and having longitudinal cuts, a flange provided at the tip of the substantially cylindrical portion, and a groove longitudinally formed on the outer side of the substantially cylindrical portion; the tip of the groove of the intermediate holder extending outwardly and radially along the inside surface of the flange; the pen point holder being tightly inserted into the cylindrical portion of the intermediate holder; a body in a cylindrical configuration, into which the intermediate holder is inserted; the body being formed with a front part and a rear part; the front part comprising a small diameter conical cylindrical portion at the front end thereof, a large diameter cylindrical portion continued from it, and a slightly small diameter cylindrical portion further continued from it; the small diameter cylindrical portion having an externally threaded portion on the outer periphery thereof; the large diameter cylindrical portion having, on the inner peripheral surface of its front portion, a plurality of high convex ribs provided longitudinally and low convex ribs disposed between these high convex ribs; an ink absorbent received inside the large diameter cylindrical portion and the slightly small diameter cylindrical portion; the front end portion of the ink absorbent being supported by the inner surfaces of the low convex ribs and the rear end portion of the ink absorbent extending outwardly from the rear end of the front part of the body; the rear part of the body is in a substantially cylindrical configuration, and having an open front end and a rear end provided with a closed bottom; the rear part having, on the inner peripheral surface of its front portion, an internally threaded portion which can be fitted to the externally threaded portion.

The other objects and advantages of the present invention will be known from the following detailed description referring to accompanying drawings.

Figure 1:
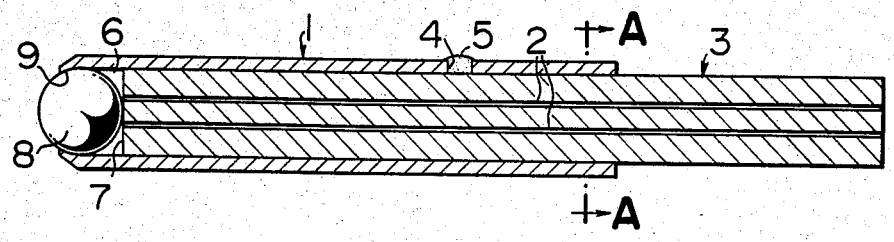
FIG. 1 is a longitudinal sectional view of a first embodiment ballpoint pen tip in a writing instrument according to the present invention.
Figure 2:
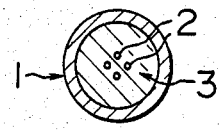
FIG. 2 is a transverse sectional view taken along line A—A of FIG. 1.

In an embodiment shown in FIG. 1 and FIG. 2, a fine tube 1 is made of a metal having a high resistance against wear and chemicals such as stainless steel, and its dimension is approximately 15 mm in length, 0.56 mm in inner diameter and 8.1 mm in outer diameter. A fine rod 3 is tightly inserted into the fine tube 1 so that one end of the fine rod 3 is disposed at a position slightly inward from one end of the fine tube 1 and the other end of the fine rod 3 extends outwardly beyond the other end of the fine tube 1. The fine rod 3 has a plurality of capillary ink flowing holes 2, which are parallel to each other longitudinally, from one end thereof through the other end in the interior thereof. The ink flowing hole 2 has a diameter of about 0.11 mm. A small hole 4 is formed in the tube wall at a mid portion of the fine tube 1 for injecting an appropriate adhesive 5, by which the fine rod 3 is fixed to the fine tube 1.

Since one end of the fine rod 3 is disposed slightly inward from one end of the fine tube 1, the fine tube 1 has a short cylindrical portion 6 at that end. The peripheral edge of the end of the short cylindrical portion 6 is annularly narrowed to define an opening 9 there. One end of the fine rod 3 is a plane which forms a ball receiving portion 7. A ball 8 is received inside the short cylindrical portion 6 and is rotatably supported by the inner peripheral edge of the opening 9 and the ballreceiving portion 7, the outer surface of the ball being partially exposed outwardly from the opening 9.

Figure 3:
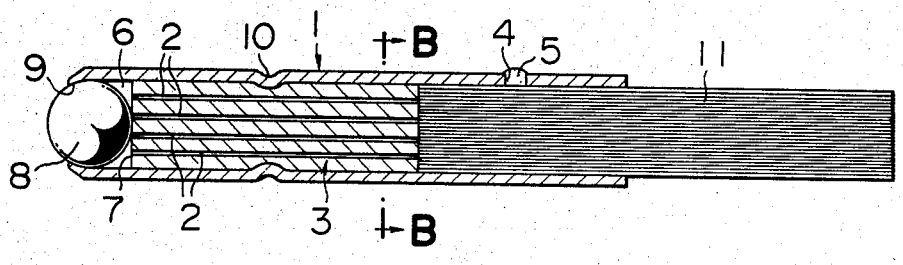
FIG. 3 is a longitudinal sectional view of a second embodiment ballpoint pen tip according to the present invention.
Figure 4:
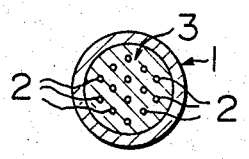
FIG. 4 is a transverse sectional view taken along line B—B of FIG. 3.

In an embodiment shown in FIG. 3 and FIG. 4, the fine rod 3 is tightly inserted only into the front end portion of the fine tube 1 and fixed to the fine tube 1 by a linear or point-like bent portion 10 on the tube wall at a mid portion of the fine tube 1. A rod-like intermediary core 11 composed of a bundle of fibers is inserted into a rear portion of the fine tube 1, the inner end of the intermediary core 11 being in contact with the rear end surface of the fine rod 3. The small hole 4 is formed midway in the wall of the fine tube 1 and the intermediary core 11 is fixed to the fine tube 1 by an adhesive 5 injected from the small hole 4. The number of the ink flowing holes 2 formed in the fine rod 3 is between 3 to 16, preferably 8.

Figure 5:
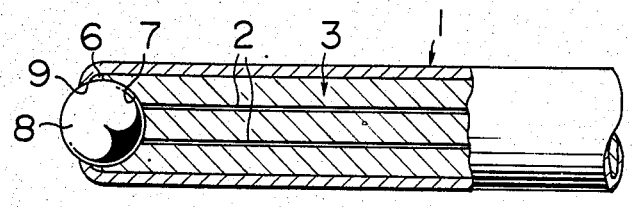
FIG. 5 is a partial longitudinal sectional and broken view of a third embodiment ballpoint pen tip in the present invention.

In an embodiment shown in FIG. 5, the ball receiving portion 7 at one end of the fine rod 3 is a concave surface and the ball 8 is rotatably in contact with this concave surface of the ball receiving portion 7 with the inward outer surface thereof.

Figure 6:
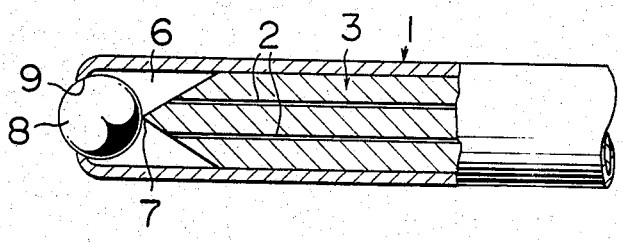
FIG. 6 is a partial longitudinal sectional and broken view of a 4th embodiment ballpoint pen tip in the present invention.

In an embodiment shown in FIG. 6, the central portion of the ball receiving portion 7 at one end of the fine rod 3 is pointed, and the ball 8 is in contact with the pointed ball receiving portion 7 with the inward outer surface thereof. In this case, it is preferred that the ball receiving portion 7 is made of particularly a material having a strong resistance to wear.

Figure 7:
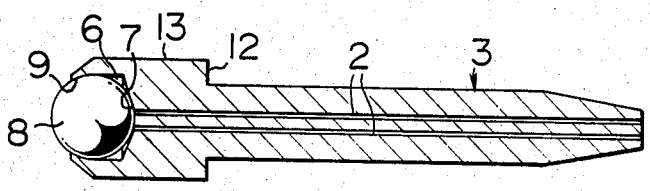
FIG. 7 is a longitudinal sectional view of a 5th embodiment ballpoint pen tip in the present invention.

In an embodiment shown in FIG. 7, the fine rod 3, which has the ink flowing holes 2 in the interior thereof, is formed integrally with an expanded head portion 13 at the front end portion thereof, and has a protruded portion or shoulder 12 on the boundary between the portion other than the front end portion and the extended head portion 13. In this embodiment, the short cylindrical portion 6 is formed at one end of the expanded head portion 13, and the peripheral edge at the end of the short cylindrical portion 6 is annularly narrowed to define the opening 9. In the short cylindrical portion 6, the inside of the bottom surface forms a concave surface, to which the ink flowing holes 2 open. The ball 8 is received inside the short cylindrical portion 6 and rotatably supported by the inner peripheral edge of the opening 9 and the concave surface of the short cylindrical portion 6.

Figure 8:
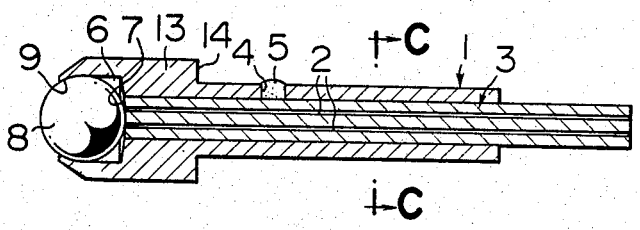
FIG. 8 is a longitudinal sectional view of a 6th embodiment ballpoint pen tip in the present invention.
Figure 9:
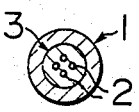
FIG. 9 is a transverse sectional view taken along line C—C of FIG. 8.

In an embodiment shown in FIG. 8 and FIG. 9, the fine tube 1 is integrally formed with the expanded head portion 13, and has a protruded portion 14 on the boundary between a portion other than the front end portion of the fine tube 1 and the expanded head portion 13. The short cylindrical portion 6 is formed at one end of the expanded head portion 13 and the ball 8 is supported in the same manner as in the embodiment shown in FIG. 1.

Figure 10:
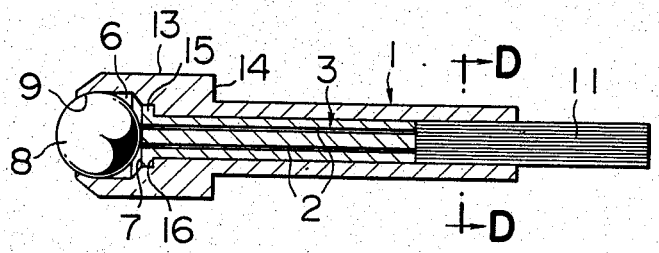
FIG. 10 is a longitudinal sectional view of a 7th embodiment ballpoint pen tip in the present invention.
Figure 11:
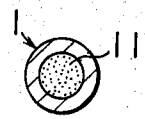
FIG. 11 is a transverse sectional view taken along line D—D of FIG. 10.

In an embodiment shown in FIG. 10 and FIG. 11, the fine tube 1 is integrally formed with the expanded head portion 13, at one end of which the short cylindrical portion 6 is formed, and a protruded portion 16 is formed on the inner bottom of the short cylindrical portion 6. At the front end of the fine rod 3, a flange-like or projected shoe-like slip stopping portion 15 is formed, the slip stopping portion 15 being engaged with the protruded portion 16. The intermediary core 11 is inserted into the fine tube 1 in the same manner as in the embodiment shown in FIG. 3.

Figure 12:
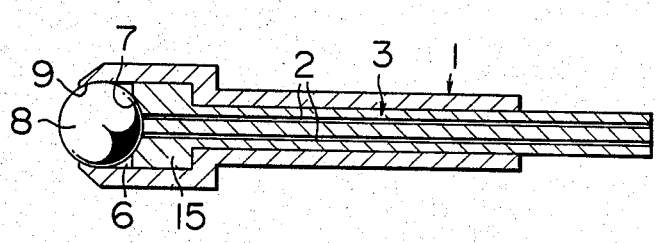
FIG. 12 is a longitudinal sectional view of an 8th embodiment ballpoint pen tip in the present invention.

In an embodiment shown in FIG. 12, the fine tube 1 is integrally formed with the expanded short cylindrical portion 6 at the front end portion thereof, and the fine rod 3 is formed with the flange-like slip stopping portion 15 at the front end thereof, this slip stopping portion 15 being engaged with a shoulder inside the expanded short cylindrical portion 6 in the fine tube 1. The slip stopping portion 15 has the ball receiving portion 7 of a concave surface at the front end thereof.

Figure 13:
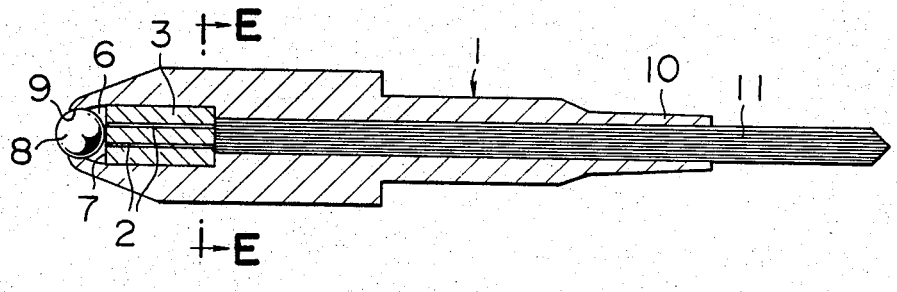
FIG. 13 is a longitudinal sectional view of a 9th embodiment ballpoint pen tip in the present invention.
Figure 14:
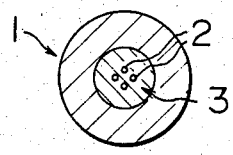
FIG. 14 is a transverse sectional view taken along line E—E of FIG. 13.

In an embodiment shown in FIG. 13 and FIG. 14, the fine tube 1 is integrally formed with the expanded short cylindrical portion 6 at the front end thereof, and the short fine rod 3 is inserted tightly into the short cylindrical portion 6. The ball 8 is rotatably supported by the front end surface of the fine rod 3 and the inner peripheral edge of the opening 9. The fine rod 3 is about 1–5 mm long. The intermediary core 11 is inserted into a major portion of the inside of the fine tube 1 and fixed to the fine tube 1 by means of the bent portion 10 at the rear end of the fine tube 1.

Figure 15A:
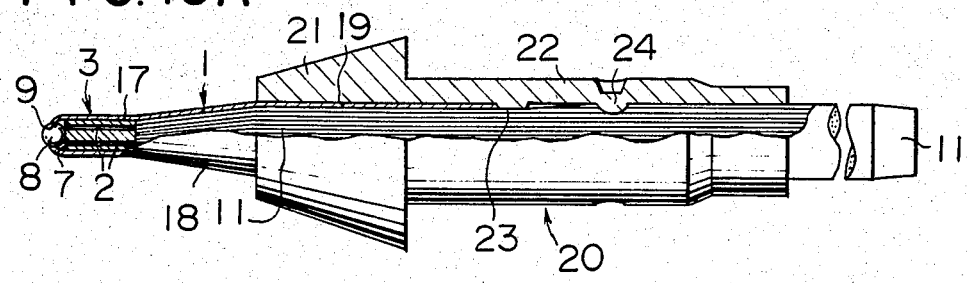
FIG. 15A is a longitudinal section of a 10th embodiment ballpoint pen tip in the present invention.

In an embodiment shown in FIG. 15A, the fine tube 1 comprises a small diameter front end portion 17, a truncated conical portion 18 continued from it, and a large diameter cylindrical portion 19 further continued from it. A hollow pen point holder 20 has a head portion 21 in a truncated conical configuration at a front end portion thereof, and a tubular guide portion 22 at a rear end portion thereof. The fine tube 1 is inserted into the pen point holder 20. On the inner wall surface of the tubular guide portion 22 of the pen point holder 20, a protruder 23 is provided, and the rear end of the fine tube 1 is in contact with the protruder 23. The intermediary core 11 is inserted through the insides of the truncated conical portion 18 and the large diameter cylindrical portion 19 and the inside of the tubular guide portion 22 and further extends to outside the tubular guide portion 22. A bent portion 24 is formed in the guide tubular portion 22 and the intermediary core 11 is fixed to the pen point holder 20 by this bent portion. If necessary, the fine tube 1 can be formed to have the same diameter as the small diameter front end portion 17.

Figure 15B:
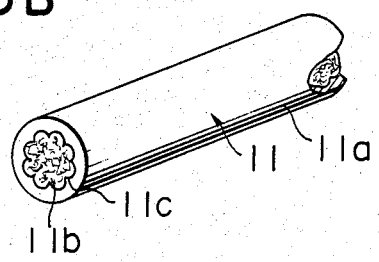
FIG. 15B is a perspective view of an intermediary core.

FIG. 15B shows another example of the intermediary core 11. Replacing the intermediary core 11 of the embodiment of FIG. 15A, one shown in FIG. 15B can be used. This intermediary core is made of a pipe of a synthetic resin or a metal 11*a* filled with felt, synthetic fiber or the like 11*b*. On the inner wall surface of the pipe, a plurality of convex ribs 11*c* are formed longitudinally to help ink transfer.

Figure 16:
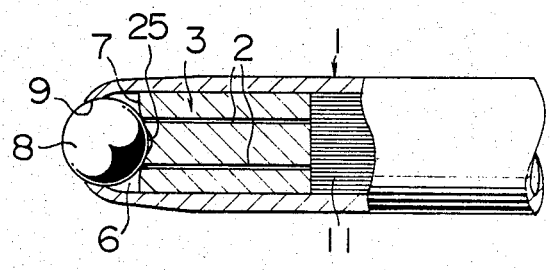
FIG. 16 is a partial longitudinal sectional and broken view of a 11th embodiment ballpoint pen tip in the present invention.

In an embodiment shown in FIG. 16, the fine rod 3 has a concave portion 25 whose section is V-shaped at the center of the front end surface thereof, which forms an ink basin.

Figure 17:
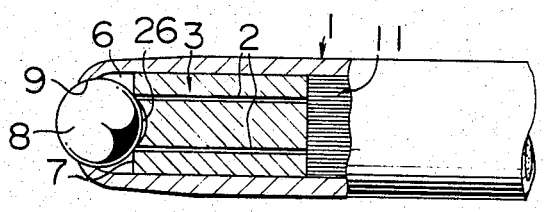
FIG. 17 is a partial longitudinal sectional and broken view of a 12th embodiment pen tip in the present invention.

In an embodiment shown in FIG. 17, the fine rod 3 has, at the center of the front end surface thereof, a concave surface or a curved surface 26 which forms an ink basin.

Figure 18:
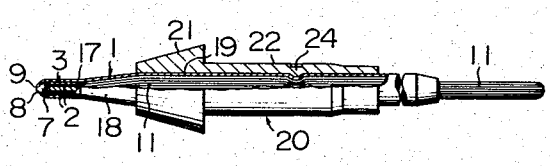
FIG. 18 is a partial longitudinal and broken view of a 13th embodiment ballpoint pen tip in the present invention.

In an embodiment shown in FIG. 18, the fine tube comprises the small diameter front end portion 17, the truncated conical portion 18 continued from it, the large diameter cylindrical portion 19 further continued from it, and the cylindrical portion 19 is inserted into the whole length of the pen point holder 20 and extends outwardly from the pen point holder 20. The cylindrical portion 19 is fixed to the pen point holder 20 by means of the bent portion 24 formed in the tubular guide portion 22 of the pen point holder 20. The intermediary core 11 is inserted into the truncated conical portion 18 and the cylindrical portion 19 of the fine tube 1, and extends outwardly from the fine tube 1.

Figure 19:
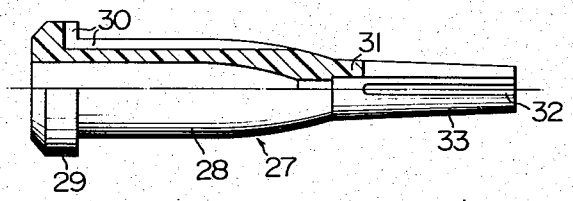
FIG. 19 is a partial longitudinal sectional and broken view of a holder to be fitted to the outer side of a guiding tubular portion in the 13th embodiment of FIG. 18.

FIG. 19 shows an embodiment of an intermediate holder 27 for the pen point holder of FIG. 18. The intermediate holder 27 which is a substantially cylindrical portion 28 has a flange 29 at the front end thereof, and a groove 30 provided longitudinally on the outer side of the cylindrical portion 28, the front end of the groove 30 extending outwardly and radially along the inner surface of the flange 29. The cylindrical portion 28 of the intermediate holder 27 has an inner diameter allowing a tight insertion of the tubular guide portion 22 shown in FIG. 18. The intermediate holder 27 has a small diameter portion 31 at the rear end thereof, and a small diameter cylindrical portion 33 continued from it having four cuts 32 provided longitudinally.

Figure 20:
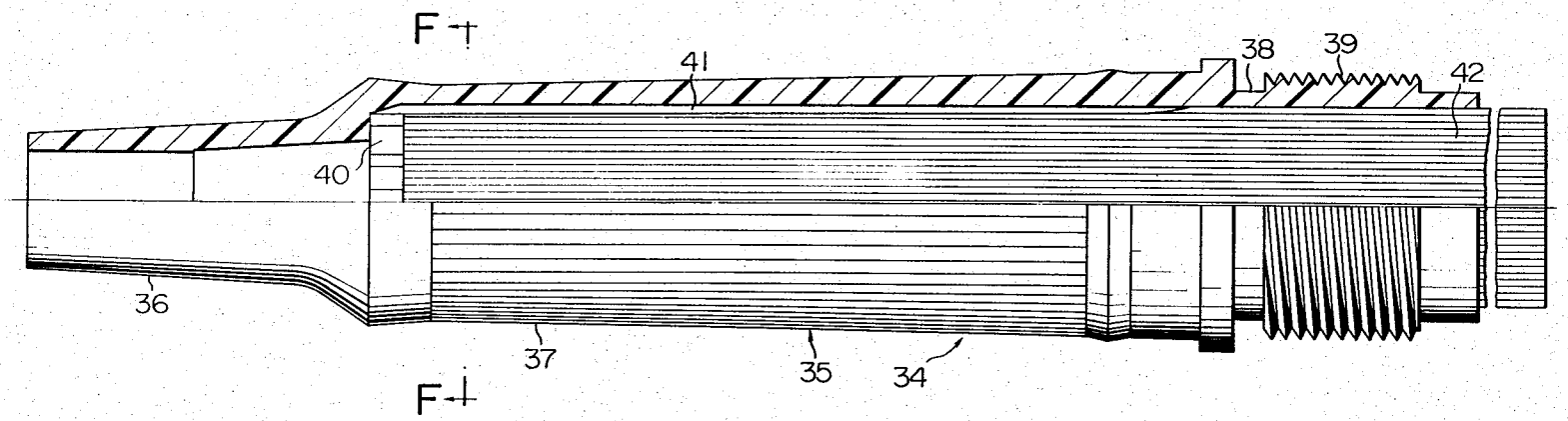
FIG. 20 is a partial longitudinal sectional and broken view of a front portion of a body into which the holder of FIG. 19 is to be inserted.
Figure 21:
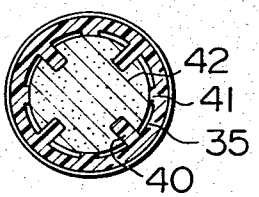
FIG. 21 is a transverse sectional view of the large diameter cylindrical portion taken along line F—F of FIG. 20.

FIG. 20 and FIG. 21 show an embodiment of a front part 35 of a substantially cylindrical body 34 into which the intermediate holder 27 shown in FIG. 19 can be inserted. The front part 35 comprises a small diameter conical cylinder portion 36 at the front end thereof, a large diameter cylindrical portion 37 continued from it, and a slightly small diameter cylindrical portion 38 further continued from it, the small cylindrical portion 38 having an externally threaded portion 39 on the outer periphery thereof. The large diameter cylindrical portion 37 has, on the inner peripheral surface of its front portion, a plurality of high convex ribs 40 as shown in FIG. 20 and FIG. 21. The embodiment shown in the drawings has four high convex ribs 40, which are disposed at equal spacings in a circumferential direction. As clearly shown in FIG. 21, the large diameter cylindrical portion 37 has, on the inner peripheral surface of its front portion, a plurality of low convex ribs 41. In the embodiment shown in the drawing, each of the low convex ribs 41 is disposed between two high convex ribs 40.

Inside the large diameter cylindrical portion 37 and the slightly small diameter cylindrical portion 38, an ink absorbent 42 composed of a bundle of synthetic fibers or the like is received, a front end portion of the ink absorbent 42 is supported by inner surfaces of the low convex ribs 41 and a rear portion of the ink absorbent 42 extends outwardly from the rear end of the front part 35 of the body 34.

Figure 22A:
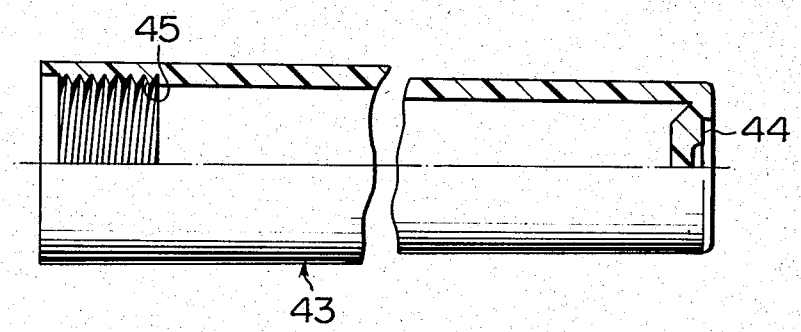
FIG. 22A is a partial longitudinal sectional and broken view of a rear portion of the body.

FIG. 22A shows an embodiment of a rear part 43 of the body 34. The rear part 43 is in a substantially cylindrical configuration, having an open front end and a rear end with a closed bottom 44. On the inner peripheral surface of a front portion of the rear part 43, an internally threaded portion 45 is provided for engaging the externally threaded portion 39.

For assembling a writing instrument with a ballpoint pen, first, the tubular guide portion 22 of the pen point holder 20 shown in FIG. 18 is inserted from the front side of the intermediate holder 27 shown in FIG. 19 into the inside of it, and then, the intermediate holder 27 is inserted from the front side of the front part 35 of the body 34 into the inside of it, and finally the front end of the rear part 43 of the body 34 is connected to the rear portion of the front part 35 of the body 34 by screwing the threaded portions 39 and 45. In this case, a sufficient amount of aqueous ink should be soaked into the ink absorbent 42 beforehand. The small diameter portion 31 in the intermediate holder 27, with the rear portion of the intermediary core 11 being disposed inside it, is sunk inside the ink absorbent 42. Since the small diameter portion 31 is formed with the cuts 32, the ink absorbent 42 makes contact with the intermediary core 11 through these cuts 32 so that the ink in the ink absorbent 42 can be transferred to the intermediary core 11.

Figure 22B:
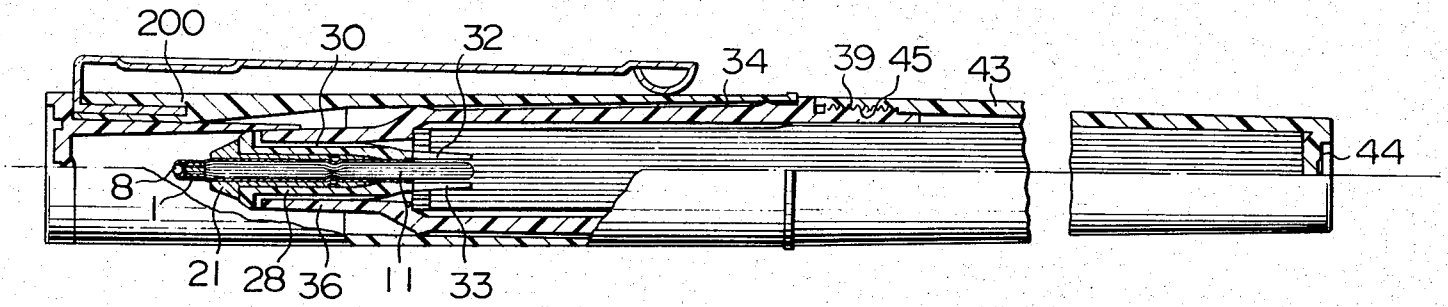
FIG. 22B shows an assembled condition of the above embodiment.

Thus, the ink permeated in the ink absorbent 42 is permeated into the intermediary core 11 by means of capillarity, and further supplied to the ink flowing holes 2 in the fine rod 3. In the writing on a piece of paper with this writing instrument, the ball 8 is rotated and the ink staying at front openings of the ink flowing holes 2 is transferred to the peripheral surface of the ball 8 so that the writing is carried out with the rotation of the ball. In accordance with consumption of the ink, the outside air enters through the ventilating grooves 30 into the body 34. FIG. 22B illustrates the assemblying condition mentioned above. Numeral 200 in FIG. 22B denotes a cap. It will be evident to those skilled in the art that the parts of the embodiments shown in FIGS. 3, 10, 13, 15, 16 and 17 can be used by inserting them into the holder 27 in the same manner as in the embodiment shown in FIG. 18.

It will be evident to those skilled in the art that a writing instrument can be assembled by inserting any of the parts of the embodiments shown in FIGS. 1, 5, 6, 7, 8 and 12 into the body 34 of the embodiments shown in FIGS. 20, 21 and 22 and by bringing the rear end of the fine rod 3 into direct contact with the front end of the ink absorbent 42.

Preferably, the ink flowing hole 2 has a diameter of 0.01–0.2 mm.

The fine rod 3 having a plurality of ink flowing holes 2 can be manufactured as follows.

Figure 29:
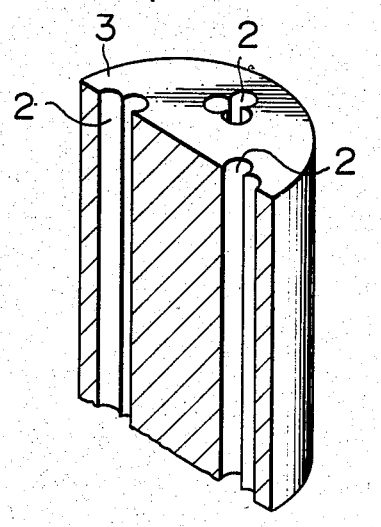
FIG. 29 and FIG. 30 are explanatory drawings of an ink flowing hole 2 of a fine rod 3.

Several fine wire rods (of 10μ–200μ in diameter) of a metal or plastic having a low melting point, which melts, burns or vaporizes at a low temperature, are arranged parallel to each other longitudinally in a hollow cylindrical member. Then, spaces between these wire rods are filled with metal powder of 5 to 100μ in diameter made of stainless steel, titan or other material having a high melting point and high resistance against corrosion and wear, and what has been made by the above process is sintered by heating to 1,000° C.–1,600° C. for melting, burning or vaporizing the wire rods only so as to form capillary ink flowing holes there. In this case, the diameter of the ink flowing hole 2 is substantially the same as the diameter of the wire rod. If necessary, wire rods are used as one wire rod by bundling several of them. In that case, a shape of a cross section of the ink flowing hole 2 thus formed varies depending on the number of wire rods bundled. For example, when a bundle of 3 wire rods is used, it is as shown in FIG. 29. That is to say, the ink flowing hole 2 is formed in an outer shape of 3 wire rods (In the case of FIG. 29, a shape of a clover leaf). This shape enhances the function of capillary tubes and helps the ink transfer in an appropriate amount.

Another method to make the fine rod 3 is as follows.

Figure 30:
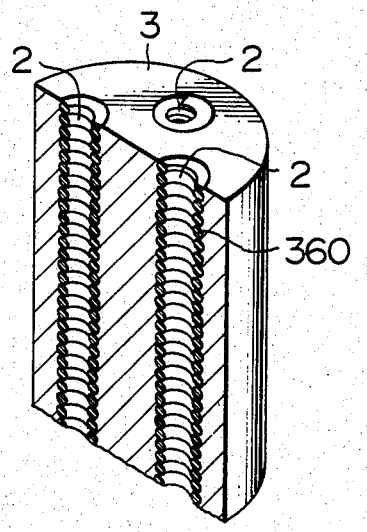

A fine wire rod 360 made of a metal having a high melting point is wound around each of the above-mentioned fine wire rods having a low melting point and a plurality of such rods are bundled to be inserted into a hollow cylindrical member, which is then heated so that the fine wire rods of a low melting point is eluted out of the hollow cylindrical member and the fine wire rods of a high melting point and deposited to each other to form an ink flowing hole in a spiral shape. FIG. 30 shows vertical sections of ink flowing holes formed in the above-mentioned process. As shown in the drawing, on the inner wall surface of the ink flowing hole 2, rods of a metal having a high melting point depositing to each other are spirally disposed. The spiral shape enhances the function of the capillary tubes and maintains transfer of the ink at a most suitable level.

The fine rod and the fine tube can be integrally formed by fitting the fine rod into the fine tube having the short cylindrical portion and having a melting substance permeate between them.

Figure 31:
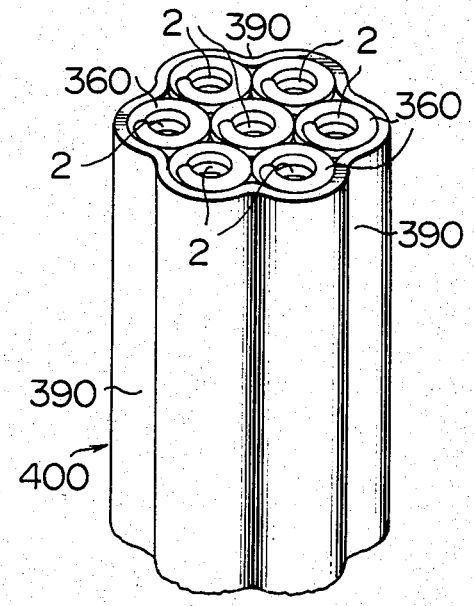
FIG. 31 is an explanatory drawing of an ink flowing hole.

In order to make the fine rod 3 a small diameter rod, if necessary, it is possible that instead of using metal powder, as shown in FIG. 31, several rod members formed by winding a fine wire rod 360 of a high melting point around a fine wire rod of a low melting point are inserted into a small diameter pipe member 400 provided with vertical concave grooves 390 on the outer periphery thereof, and after inserting the small diameter pipe member 400 into the fine tube 1, it is sintered by being heated together with the fine tube 1. In this case, when sintered, the fine wire rods of a low melting point are eluted and the fine rods 360 having a high melting point, the small diameter pipe member 400 and the fine tube 1 are integrally sintered and joined.

Further, vertical concave grooves 390 formed on the outer periphery of the small pipe member 400 between the fine rod 1 and the small diameter pipe member 400 serve as holes to flow ink.

It will be also evident that a fine rod of a required length can be provided by cutting a long fine rod manufactured by any of the above-mentioned methods.

Metals partly containing metal nitride or metal carbide can be used to make the fine rod.

The ball can be made of such hard materials as superhard metals or ceramics.

In the following, brief explanation will be given about writing instruments using ballpoint pens accordance to the present invention shown in FIG. 23 and on.

Figure 23A:
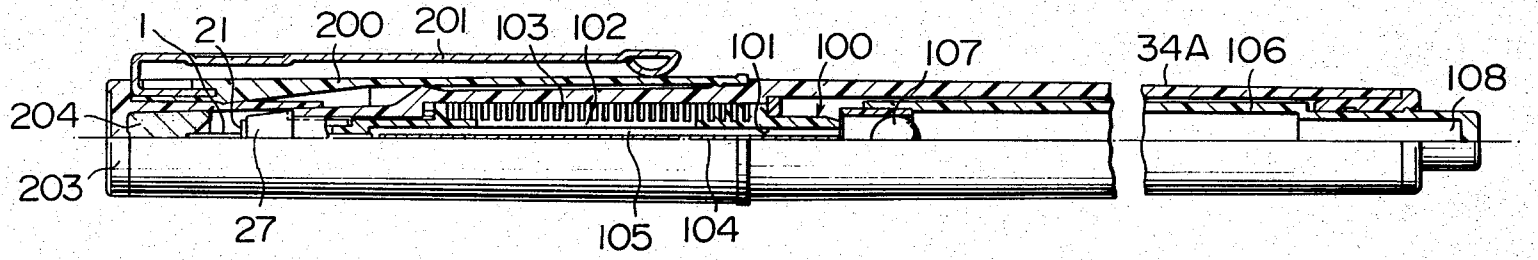
FIG. 23A is a partial longitudinal sectional and broken view of a 14th embodiment writing instrument with a ballpoint pen tip according to the present invention, before an ink tank is set to it.
Figure 23B:
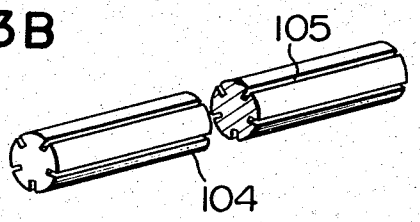
FIG. 23B is a partial perspective view of the embodiment of FIG. 23A.

In FIG. 23A, a separate ink control member 100 is disposed at a front portion inside a body 34A.

The ink control member 100 has a penetrating hole 101 penetrating from forward to backward and at a mid portion of the penetrating hole 101, several slits 102 connecting to the outer peripheral surface of the control member is formed axially. On the outer peripheral surface of the control member 100 at a position where the slits 102 are formed, a plurality of fins 103 are formed parallel to each other.

Further, an ink control stick 104 is inserted into the penetrating hole 101. The ink control stick 104 has a shape shown in FIG. 23B and an outer dimension substantially identical with the penetrating hole 101. On the other peripheral surface, several slits 105 are formed longitudinally from one end through the other. To the front end opening portion of the body 34A, the front end of the embodiment shown in FIG. 15 or FIG. 18 is fitted, and the small diameter cylindrical portion 33 of the intermediate holder 27 is, together with the intermediary core 11 inside, fitted to the front end opening portion of the ink control member 100.

Inside the rear portion of the body 34A, an ink tank 106 is disposed. The front portion of the ink tank 106 is sealed by a ball 107 and the rear portion extends outwardly from the opening of the body 34A to form a pushing portion 108.

Numeral 200 denotes a cap, 201 denotes a clip, and 203 denotes a head portion-fitting small cap which functions to fix the clip 201 by being fitted into the head portion of the cap 200. Numeral 204 denotes a pen tip end protection member fixed inside the small cap 203. The protection member 204 made of sponge, felt, soft rubber or the like prevents drying of ink exuded to the front end portion of the pen tip, as well as prevents sticking of dust.

Figure 24:
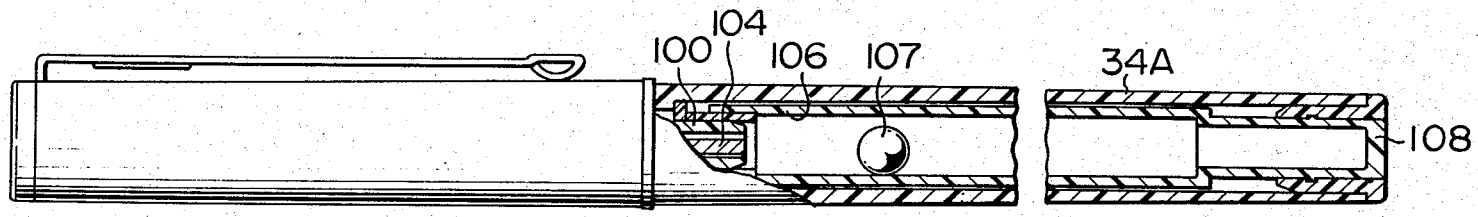
FIG. 24 is a partial longitudinal sectional and broken view of the embodiment of FIG. 23.

FIG. 24 shows the embodiment of FIG. 23A being in a condition ready for use. As shown in the drawing, by pushing a push portion 108, the ink tank 106 is fitted into the rear end portion of the ink control member 100, and simultaneously the ball 107 which has sealed the opening portion of the ink tank is moved so that the ink inside the tank is transferred to the penetrating hole 101 of the ink control member 100. In case the amount of ink that has flowed into the penetrating hole 101 exceeds an appropriate level, it exudes from the slits 105 to the spaces between a number of fins 103 and is reserved there, which decreases in accordance with consumption of the ink at the pen tip.

Figure 25:
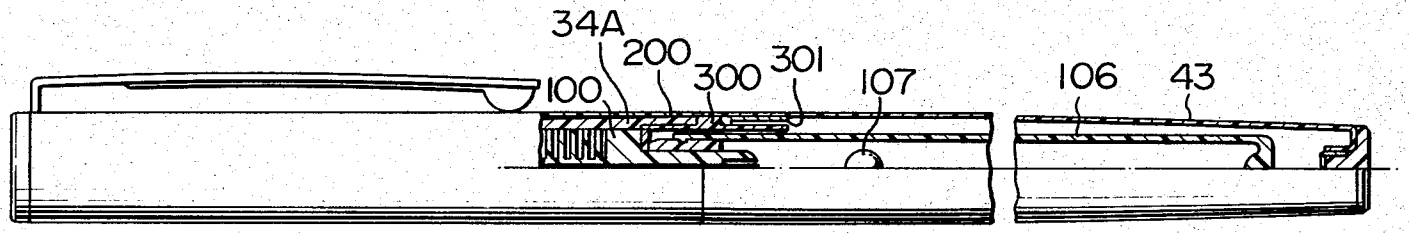
FIG. 25 is a partial longitudinal sectional and broken view showing a 15th embodiment of an ink tank system.

Next, an embodiment shown in FIG. 25 will be described. This embodiment is fundamentally same as the embodiment of FIGS. 23 and 24. A difference is that the ink tank 106 is of a replaceable cartridge type. That is to say, when the ink in the ink tank 106 has decreased by consumption, the rear part 43 of the body is pulled out of a joint member 300 so as to expose the ink tank 106, and a new ink tank full of ink is fitted to the rear of the ink control member 100. One end portion of the joint member 300 is fixedly fitted to the body 34A, the other end being fitted through a leaf spring 301 or the like to the opening portion of the rear part 43 of the body. The ink tank 106 is entirely covered by the rear part 43 of the body, and the rear pushing portion 108 does not extended outwardly from the rear part 43 of the body in the same manner as in the embodiment of FIG. 23.

Next, an embodiment shown in FIG. 26 will be described. In this embodiment, the ink absorbent 42 is disposed within the body 34. To the front end opening portion of the body 34, the ballpoint pen tip shown in FIG. 15 or FIG. 18 is fitted, and the rear end portion of the ballpoint pen tip is fitted to the front end portion of the above-mentioned ink absorbent 42. When the ink absorbed in the ink absorbent 42 has decreased with the use of this embodiment of the writing instrument, the front part 35 of the body 34 is removed from the body 34 and the front part 35 in which the ballpoint pen tip and the ink absorbent 42 are integrally formed is discarded as it is, namely, the ink absorbent attached with the ballpoint pen tip is discarded. Then, the ink absorbent in a condition indicated in FIG. 27 is used as a replacement.

Figure 26:
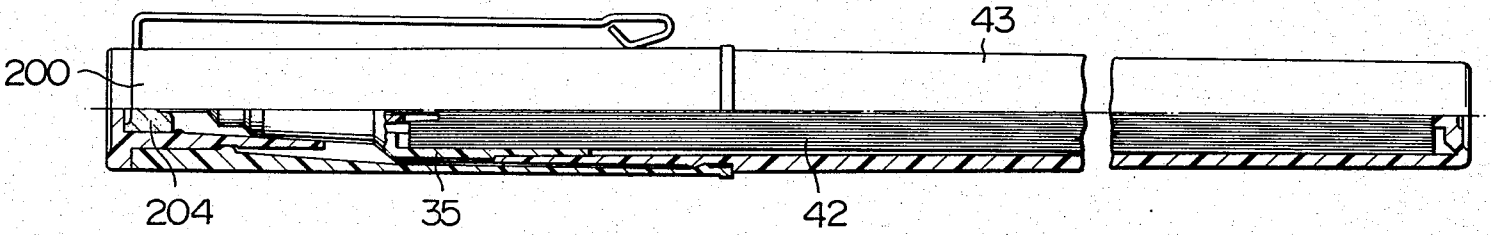
FIG. 26 is a partial longitudinal sectional and broken view of a cartridge type 16th embodiment writing instrument with a ballpoint pen tip according to the present invention, which has a replaceable ink absorbent 42.
Figure 27:
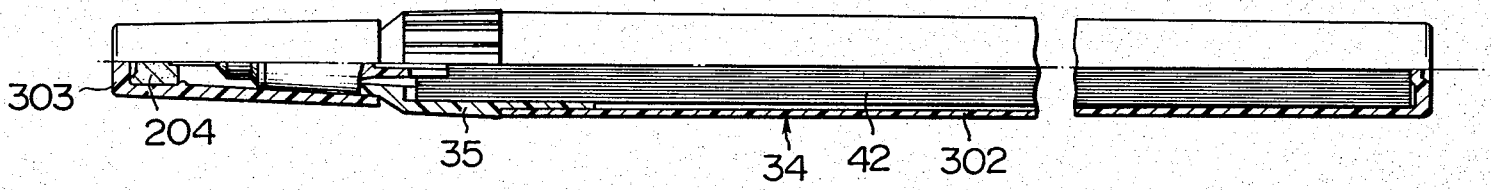
FIG. 27 is a partial longitudinal sectional and broken view showing a spare ink absorbent for use in the embodiment writing instrument of FIG. 26.

The ink absorbent 42 shown in FIG. 27 is received in a cover 302, of which an open front end portion is fittingly attached to the front part 35 of FIG. 26, and the front end portion of the front part 35 is further attached fittingly with a cartridge cap 303 to cover the ballpoint pen tip. Accordingly, in case the cartridge shown in FIG. 27 is used, the cartridge cap 301 is removed and after the cover 302 is removed from the front part 35 to expose the ink absorbent, the ink absorbent 42 is covered by the body 34 shown in FIG. 26 so that the ink absorbent is fitted into the body 34, and the body 34 is fixed to the front part 35 of FIG. 27. The cap of FIG. 26 is used as it is.

Next, FIG. 28A will be explained. In this embodiment, the ink absorbent 42 is disposed inside the cartridge cover 302, and a tail plug 304 seals a rear opening portion of the cartridge cover 302 in which the ink absorbent 42 is received, and the front opening portion of the cartridge cover 302 is fittingly attached with a ballpoint pen tip. The rear part 43 of the body is outside the cartridge cover 302, and a resilient control member 305 is interposed between the rear part 43 of the body and the tail plug 304 of the cartridge cover 302. The front part 35 of the body is fittingly fixed to the front opening portion of the rear part 43 of the body, and the cartridge cover 302 is strongly fixed by the rear part 43 of the body and the front part 35 of the body. The cartridge cover 302 extends from the front end opening portion of the front part 35 of the body, and consequently, a front end portion of the ballpoint pen tip fixed to the front end of the cartridge cover 302 extends outwardly from the front part 35 of the body.

Figure 28A:
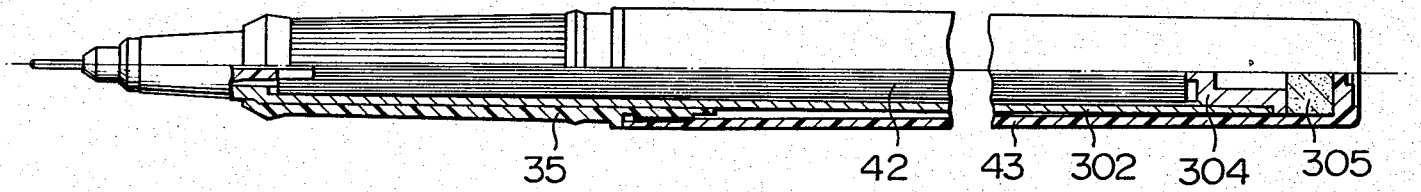
FIG. 28A shows an ink absorbent replacing type of the 17th embodiment.
Figure 28B:
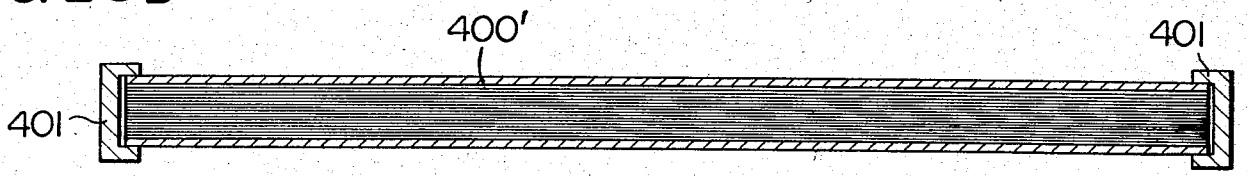
FIG. 28B is a longitudinal section of an ink case.

To replace the ink absorbent in this embodiment, the rear part 43 of the body is separated from the front part 35 of the body to take out the cartridge cover 302 with the ballpoint pen tip being attached thereto, and a new cartridge cover 302 with a ballpoint pen tip is set as shown in FIG. 28A. It is not impossible to replace only the ink absorbent with a new one. In the case, the tail plug 304 is removed to pull out the like absorbent 42 from the inside, and take out the ink absorbent 42 received within a case 400' as shown in FIG. 28B from the case 400' by removing a plug 401 to exchange it with a new one.

We claim:

1. A writing instrument with a ballpoint pen tip, comprising:

a hollow pen point holder having a truncated conical head portion at the front end thereof and a tubular guide portion continued from said head portion;

a fine tube having an end portion annularly narrowed to define an opening, a small diameter front end portion continued from said end portion, and a substantially cylindrical portion continued from said small diameter front end portion, said fine tube, at said substantially cylindrical portion thereof, being tightly inserted into said hollow pen point holder and having a rear end that extends outwardly from said hollow pen point holder;

a metallic fine rod tightly inserted into said small diameter front end portion of said fine tube, said metallic fine rod having a plurality of capillary ink flowing holes extending through the interior of said rod from the front end to the rear end of said rod;

a ball rotatably supported between said annularly narrowed end portion defining said opening and the front end of said fine rod; and means for introducing aqueous ink to the rear end of said fine rod, said means being tightly inserted into the substantially cylindrical portion of said fine tube and connected to the rear end of said fine rod, said tubular guide portion of said hollow pen point holder having a bent portion which fixes said fine tube to said tubular guide portion.

2. A writing instrument with a ballpoint pen tip, comprising:

a hollow pen point holder having a truncated conical head portion at the front end thereof and a tubular guide portion continued from said head portion;

a fine tube having an end portion annularly narrowed to define an opening, a small diameter front end portion continued from said end portion, and a substantially cylindrical portion continued from said small diameter front end portion, said fine tube, at said substantially cylindrical portion thereof, being tightly inserted into said hollow pen point holder and having a rear end that extends outwardly from said hollow pen point holder;

a metallic fine rod tightly inserted into said small diameter front end portion of said fine tube, said metallic fine rod having a plurality of capillary ink flowing holes extending through the interior of said rod from the front end to the rear end of the said rod;

a ball rotatably supported between said annularly narrowed end portion defining said opening and the front end of said fine rod;

means for introducing aqueous ink to the rear end of said fine rod, said means being tightly inserted into the substantially cylindrical portion of said fine tube and connected to the rear end of said fine rod;

a hollow intermediate holder, into which said pen point holder is tightly inserted, having a first substantially cylindrical portion near the front end thereof which forms a flange, a smaller diameter cylindrical portion continued from said flange, a second substantially cylindrical portion continued from said smaller diameter cylindrical portion and provided with longitudinal cuts, and a ventilating groove longitudinally formed on the outer side of said smaller diameter cylindrical portion that extends along the rear surface of said flange radially and outwardly;

a substantially hollow body, into which said intermediate holder is inserted, of substantially cylindrical configuration, having a front part and a rear part that are removably engaged, wherein the front part is provided with a large diameter cylindrical portion having a plurality of high convex ribs placed longitudinally along the front portion of the inner peripheral surface and a plurality of low convex ribs disposed between the high convex ribs, and wherein the rear part is provided with an open front end and closed rear end; and an ink absorbent received inside said front part of said hollow body and extending outwardly therefrom, said ink absorbent having a front end portion supported by said low convex ribs.

* * * * *